United States Patent [19]

Bobak et al.

[11] 4,186,394

[45] Jan. 29, 1980

[54] AUTOMATIC DISPLAY SYSTEM AND PROCESS

[76] Inventors: Tadeusz Bobak; Tadeusz C. Bobak, both of 540 San Vicente Blvd., Apt. 4, Santa Monica, Calif. 90405

[21] Appl. No.: 942,972

[22] Filed: Sep. 18, 1978

[51] Int. Cl.[2] ..... G09F 9/32

[52] U.S. Cl. ..... 340/764; 40/513; 340/373; 340/783; 358/230

[58] Field of Search ..... 340/373, 378.2, 764, 340/783; 40/470, 513

[56] References Cited

U.S. PATENT DOCUMENTS

| | | | |
|---|---|---|---|
| 1,049,240 | 12/1912 | Janecek | 340/764 X |
| 1,069,582 | 8/1913 | Schaefer | 340/764 X |
| 1,713,213 | 5/1929 | Bissiri | 340/764 X |
| 1,796,030 | 3/1931 | Kell | 340/764 X |
| 3,270,447 | 9/1966 | Langdon | 340/764 X |
| 3,460,135 | 8/1969 | Gardner | 340/764 X |
| 3,482,344 | 12/1969 | Holloman | 340/764 X |
| 3,486,258 | 12/1969 | Müeller | 340/764 X |

*Primary Examiner*—David L. Trafton

*Attorney, Agent, or Firm*—Ostrolenk, Faber, Gerb & Soffen

[57] ABSTRACT

An image display system and process are disclosed. The image display system comprises a generally flat display screen which is subdivided into a plurality of display mode modules, each display module being composed of a plurality of display elements. Each display element comprises at least one rectangular display cell wherein a projection block is movable between a retracted position, where it is invisibly lodged within the cell, and an advanced position, where it is visible from outside by the display's viewer. Each projection block is fixed to a slide movable in the two directions perpendicular to the front plane of the display. Means are provided to simultaneously actuate all slides in their retracting and their advancing movement. Stop means are provided between the sliders and the screen frame to stop the advancing movement of those sliders whose associated projection block is to remain in the interior of its cell so as to display a dark spot and means are provided to pre-set a new image behind the panel plane during the display of predetermined.

18 Claims, 10 Drawing Figures

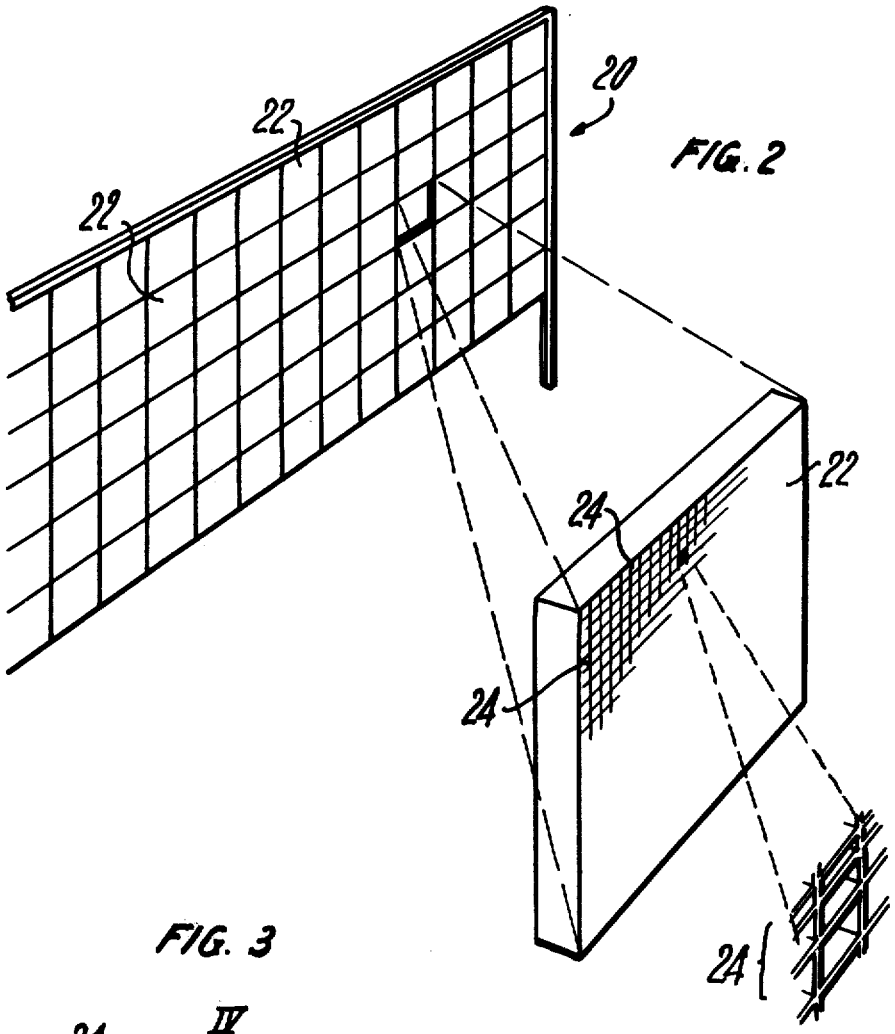
FIG. 2
FIG. 3
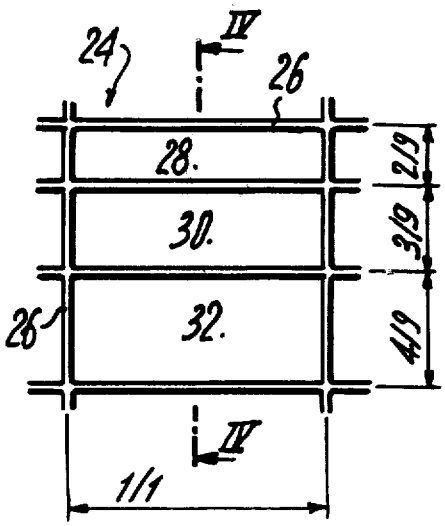
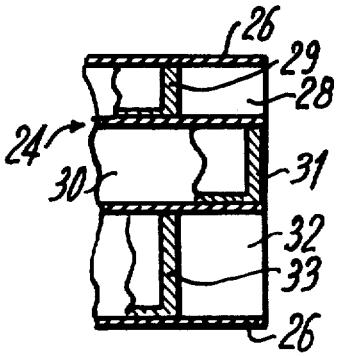
FIG. 4

F
R
S
F
29
44
42
46
34
29
42
40
35
36
46
48
52
38
64
66
52
50
96
98
90
92
94
100
86
88
91
84

48
52
50
38
66
67
74
76
72
70
82
80
66
64
38

AUTOMATIC DISPLAY SYSTEM AND PROCESS

BACKGROUND OF THE INVENTION

This invention relates to an image display system. More particularly, the invention relates to an image display panel or screen which is automatically actuated to display different or varying images of all kind of visible information like portraits, objects, scenes, alphanumeric information in a long or short lasting manner. The invention further relates to an image display process.

Devices for displaying different images are known in the art. Thus, U.S. Pat. No. 3,273,140 discloses a display panel equipped with a multitude of lamps which are partially lighted according to a program so that an image can be formed by the combination of illuminated and dark lamps. Furthermore, a similar device has been known from U.S. Pat. No. 2,239,522 where color lamps are used. Another kind of display panel has been proposed in U.S. Pat. No. 3,270,447. In this patent, the display screen is divided into a multitude of cells wherein a reflector is provided in each such cell, the reflectors being able to be moved at different depths in their respective cells by means of solenoids having multiple windings.

These known devices suffer from the serious disadvantage that their electrical energy requirements are tremendously high; furthermore, they are quite expensive to manufacture, and in display panels using electric lamps, maintenance problems are severe since lamps must often be replaced, and replacement is not easy. The lighted spots in lamp display panels further do not cover the entire surface of the panel since the lamps have a circular front area.

It is therefore an object of the present invention to provide a novel display panel or screen which is automatically actuated to selectively exhibit different visible information like images of persons, scenes, signs, advertisements, etc.

It is a second object of the invention to provide a display system which is perfectly visible in normally or artifically lighted rooms like halls, airport lounges, etc., and which can also be used as a daytime outside display.

It is a further object of the invention to provide a display system capable of showing images comprising the so-called half tone reproduction.

It is another object of the invention to provide a display system similar to a dot matrix where the individual dots cannot be distinguished by the naked human eye, the displayed image thus appearing as a continuous dot-free pattern.

Still a further object of this invention is a display panel composed of modules, each module comprising a plurality of elements which are each composed of display sub-elements.

A still further object of the invention is to provide such modules, elements and sub-elements which are very simple and inexpensive but are working with perfect reliability.

It is another object of the invention to provide a process for displaying images wherein, when a particular and predetermined image is being displayed, the next one is pre-set behind the display panel so that a sequence of images can be displayed in short intervals.

BRIEF SUMMARY OF THE INVENTION

In accomplishing the above objects of the invention, there is provided a display system comprising a generally flat display panel being subdivided into display modules, each display module being composed of a plurality of display elements. Each display element comprises at least one rectangular display cell wherein a projection block is disposed movably from a retracted position, where it is invisibly lodged within the cell, to an advanced position where it is visible from outside by the display's viewer, the front surface of the block being substantially in the front plane of the screen. Each projection block is fixed to a slider movable in the two directions perpendicular to the general screen plane and means are provided to simultaneously actuate all slides in their retracting and their advancing movement. Stop means are provided between the sliders and the panel frame to stop the advancing movement of those sliders which are to remain in the interior of its cell so as to display a dark spot on the panel.

Further menas are provided to pre-set a successive image behind the display panel by setting elements. The stop means are influenced by the setting elements when all sliders are simultaneously retracted. On the following advancing movement of these sliders whose projection blocks should remain within its cell, are stopped before each respective block will reach its fully adavanced, visible position.

The display process of the invention consists in the following steps:

(1) providing a magnetic record of an input image, said magnetic record comprising dot-by-dot information as to the brightness value of each image dot,
(2) converting said magnetic record in electrical pulses for energizing an image pre-forming system,
(3) setting a dot matrix image behind a display panel, each dot of said dot matrix receiving and storing information of the brightness of the corresponding input image dot,
(4) resetting to darkness the display of said display panel and simultaneously transferring all dot information to the reset display,
(5) setting the display image, and
(6) resetting the dot matrix image behind the display panel.

In a preferred embodiment of this process, these steps are simultaneously performed on modules, i.e. geometric surface fractions as well of the input image as of the output, display image. The information of the brightness of each image dot can be a binary one, i.e. white or not white, or preferably can comprise grey values.

Other objects and characteristic features of the invention will become apparent as the descriptions proceeds.

BRIEF DESCRIPTION OF THE DRAWINGS

Therefore, the invention will be better understood and objects other than those set forth above, will become apparent when consideration is given to the following detailed description of the preferred embodiment thereof. It should be understood that the invention is not limited to the precise arrangements and instrumentalities shown. Such description makes reference to the annexed drawings wherein FIG. 2 is a schematic perspective view of the general construction of the display panel, viewed from its front, FIG. 3 is a front view of one display element, showing its subdivision in sub-elements, FIG. 4 shows a cross-section of the element of FIG. 3 in the plane indicated by IV—IV, the rear parts being broken away.

DETAILED DESCRIPTION OF THE INVENTION

The display system of the invention provides a continuous, substantially dot-free image or pattern. The theoretical optical basis therefore is illustrated in FIG. 1.

It is well known that the human eye cannot distinguish two dots as such which have a distance from each other less than about 0.1 mm at the normal visual range, i.e. at about 25 to 30 cm.

Figure 1:
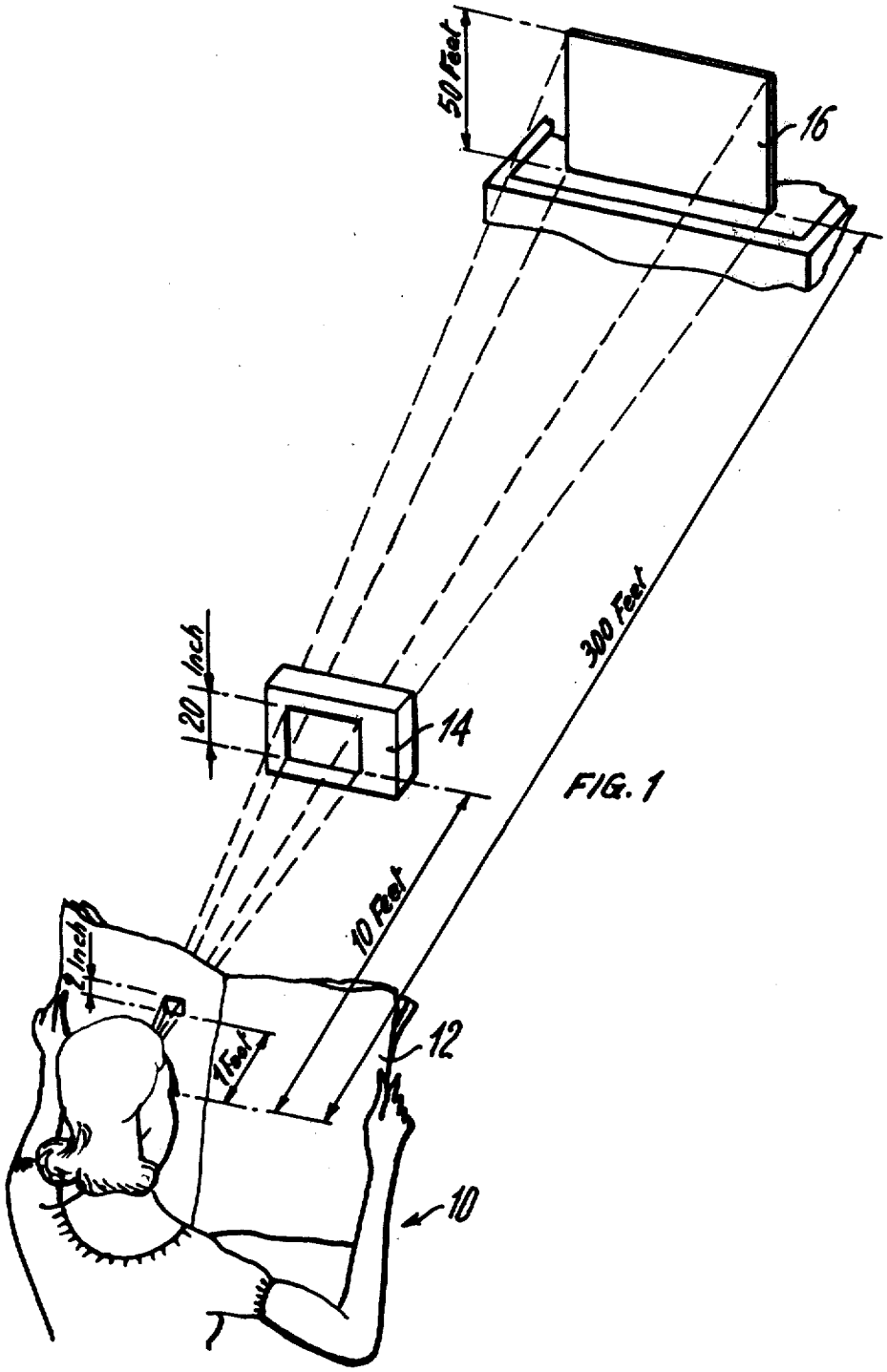
FIG. 1 is a schematic perspective view to illustrate the optical basis of a large size display.

In FIG. 1, the reader 10 holds a newspaper 12 at the visual distance of 1 foot. She looks at a picture being about 2 inch in height. The newspaper picture is composed, in a conventional manner, of dark and light dots having a distance, in the picture plane, of less than about 4 mils (0.1 mm) so that the picture appears as a continuous one. This picture remains continuous if it is shown on a TV screen 14, about 20 inch (50 cm) high, when a visual distance thereto of about 10 feet is selected, although its dark and light dots are greater. On the TV screen, 625 lines are displayed so that the distance between two adjacent lines is 50:625=0,08 cm or 0.8 mm. Since the visual distance is 10 feet (3,14 m), the TV picture gives the same continuous visual impression as a newspaper picture of 2 inch at 1 foot; the apparent distance between two adjacent vertical dots (corresponding to the TV picture lines) will be 0.8:10=0.08 mm, a value inferior to the resolution limit of 0.1 mm (at the normal visual range). Now, if a display panel 16 is seen at a distance of 300 feet, a dot distance of 0.1 mm in the normal visual range (1 foot) will correspond to a dot distance and, at the same time, to a dot diameter of $0.1\times300=30$ mm. Therefore, if the display on panel 16 should be composed of dark and light dots or elements having a linear dimension in the panel plane of not more than 30 mm (i.e. between 1⅛ and 1¼ inch), the thus formed image will appear continuous to the viewer at a visual distance of 300 feet or more.

The display panel of the invention takes advantage of this fact in having its surface divided into elements which may have a height and width of ½ to 1 inch. Images on such a panel appear continuous at a visual distance of 150 to 250 feet. At shorter distances, the image appears slightly dotted but still perfectly recognizable.

The general arrangement of the display panel is shown in FIG. 2. The large display panel or screen 20, having dimensions of about 2 to 15 m high and 4 to 30 m wide is subdivided in a plurality of identical modules 22. Preferably, each module has a dimension of $50\times50$ cm. All modules 22 are of the same construction which is described below. Each module 22 is composed of a plurality of identical display elements which are also described below. Each display element 24 consists of at least one cell. In FIG. 2, there is shown a preferred embodiment wherein the display elements 24 each include three cells 28, 30, 32 having the same breadth but different heights. The total array of the three cells, forming the display element 24, has the same height and width, e.g. about 2.5 cm (1 inch).

Such an element 24 is shown in FIG. 3 in a front view and in FIG. 4 in a cross-section in the plane IV—IV of FIG. 3. All elements 24 are substantial square or rectangularly shaped. The totality of all elements 24 of one module 22 are forming a honeycomblike network, by their walls 26, and this network is that of the module 22 (see FIG. 2). In each cell, 28, 30, 32, a respective projection block 29, 31 and 33, is disposed. The width of all three cells is the same, say 1/1 in arbitrary units. However, their height is different: by way of example, cell 28 makes up 2/9 of the total height, cell 30 ⅓ or 3/9, and cell 32 4/9 of the total height of the element. The interior surfaces of the walls 26 are in dark color, preferably black, whereas all blocks 29, 31, 32 are clear or white at least on their frontal surfaces.

The reason why each element 24 is preferably divided into three sub-elements 28, 30, 32 is the following:

Pictures formed of deep black spots or dots on white ground appear harsh and do not show any tridimensional effect. However, if half tones are introduced, the picture becomes smooth and appears to be plastic or tridimensional. The preferred embodiment of the invention permits to obtain this plastic effect by introducing half tones.

In the system herein described, eight gradations between white and black were selected. Referring now to FIGS. 3 and 4, a fully white color of the spot represented by the element 24 is obtained when all three blocks 29, 31, 33 are in their front or advanced position. This corresponds to grade 8 of the grey scale. Now, when block 28 is retracted, 7/9 of the total element surface appears white and 2/9 appears black, block 29 being no longer visible. This represents grade 7 on the grey scale.

In the following Table 1, the grey scale grades depend from various positions of blocks 29, 31 and 33. In this Table, the word "out" indicates that the respective one of blocks 29, 31, 33 is in its advanced or frontal position, displaying its white front surface, whereas "in" indicates that the block is in its retracted position, where it is not visible, leaving its cell in the dark (black) condition.

TABLE 1

| block position FIGS. 3 and 4) | | | fraction of white | grade of grey |
|---|---|---|---|---|
| 29 | 31 | 33 | surface | scale |
| out | out | out | 9/9 | 8 (white) |
| in | out | out | 7/9 | 7 |
| out | in | out | 6/9 | 6 |
| out | out | in | 5/9 | 5 |
| in | in | out | 4/9 | 4 |
| in | out | in | 3/9 | 3 |
| out | in | in | 2/9 | 2 |

TABLE 1-continued

| block position FIGS. 3 and 4) | | | fraction of white surface | grade of grey scale |
|---|---|---|---|---|
| 29 | 31 | 33 | | |
| in | in | in | 0/9 | 1 (black) |

It is obvious from this Table that all grades of the grey scale and thus all desired half tones can be represented and displayed by an appropriate combination of the advance or non-advance of three projection blocks having suitable frontal surface areas. How the advance or non-advance of these blocks is controlled will be explained later. The particular construction of the elements will first be described.

Figure 5:
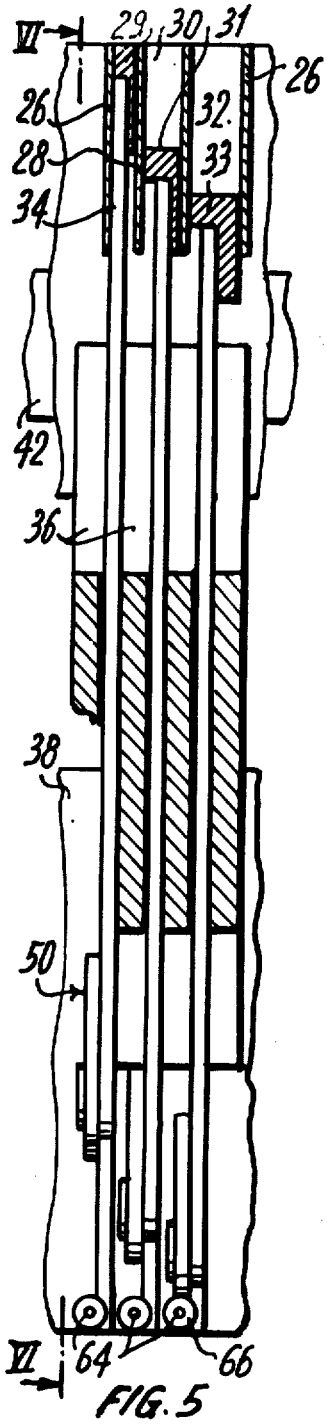
FIG. 5 is a cross-section of the element of FIG. 3 in the plane IV—IV, in one of its practical embodiments, the section having been taken in the plane V—V of FIG. 6.
Figure 6:
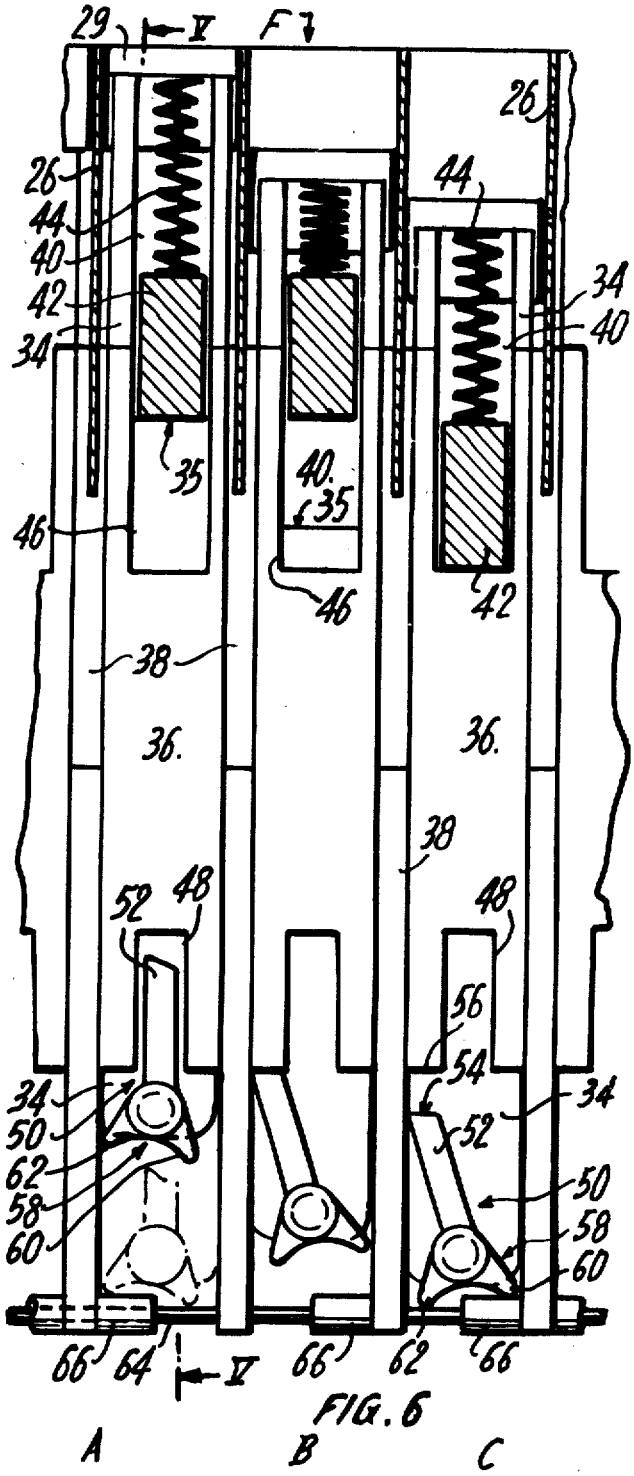
FIG. 6 is a partially sectioned top view of the element of FIG. 5, in the plane VI—VI, three laterally arranged elements being shown in different functional stages.

FIG. 5 shows a cross section analoguous to that of FIG. 4; similar parts bear the same reference number. FIG. 6 represents a top view on the element seen from the plane VI—VI in FIG. 5. In FIG. 6, three elements are shown in laterally adjacent relationship.

Referring now to FIGS. 5 and 6, the first projection block 29 is slidably arranged in a cell 28 formed by walls 26. The second and third projection blocks 31 and 33 of the same element are similarly lodged in cells 30 and 32. Each projection block is fixed to a slider 34 of flat rectangular section slidably housed between horizontal guides 36 and vertical guides 38. There are 151 horizontal and 51 vertical guides so that the module forms a honeycomb comprising $(151-1)\times(51-1)=7500$ flat rectangular openings or cavities. Thus, these 7500 cavities are arranged in 150 horizontal rows, each row comprising 50 openings.

The honeycomb block represents the main body of the module. The 7500 corresponding, identical sliders 34 are placed in the openings as shown in FIGS. 5 and 6; they are able to slide in the openings with reasonable play.

Each slider 34 is provided, near its front end 35 against the projection block, with a rectangular slot 40. Vertical resetting bars 42 extend through these slots 40 of all sliders 34 forming a vertical column. All resetting bars 42 are joined together in the same plane above and below the elements of the module by horizontal bars, one of them being shown in FIG. 8, thus forming a rigid resetting grid. Flat springs 44 are placed between the rear surface of each of blocks 29, 31, 33 and the front surface of the corresponding resetting bar 42. These springs 44 are not represented in FIG. 5 for sake of clarity. The horizontal guides 36 are provided with rectangular recesses 46 at their ends directed to the front F of the panel (the top in FIGS. 5 and 6). These recesses 46 have about the same width as the slots 40 in the sliders 34; when the resetting bars 42 will move in a direction perpendicular to the panel surface plane, they can enter the recesses 46.

At their end opposite to the recess 46, each horizontal guide 36 is provided with a guide slot 48. A flat stop pawl 50 is pivotally fixed near the rear end of each slider 34. The stop pawl has a leg 52 adapted to slide free in the guide slot 48 of the corresponding horizontal guide 36. The leg 52 has an angular front end 54 adapted to come in abutting contact with the stop surface 56 at the end of the horizontal guide 36. Furthermore, the stop pawl 50 is provided, at its portion opposite to the leg 52, with a fork 58 having two arms 60 and 62 forming two different angles with the leg.

In the rear end of the vertical guides 38, horizontal wires 64 are lodged; their axis lies substantially in the plane formed by the stop pawls 50 of one horizontal row of display elements. Setting cores 66, one for each sub-element, are provided on the wires 64. Setting cores 66 are tiny seal cylinders which can slide on the wire 64, between two positions, a left-hand one, called "white" position, and a right-hand one, the "black" position. In FIG. 6, two cores are in the black position (elements B and C), and one core, at the left of this FIGURE, is in the white position (element A).

Figure 8:
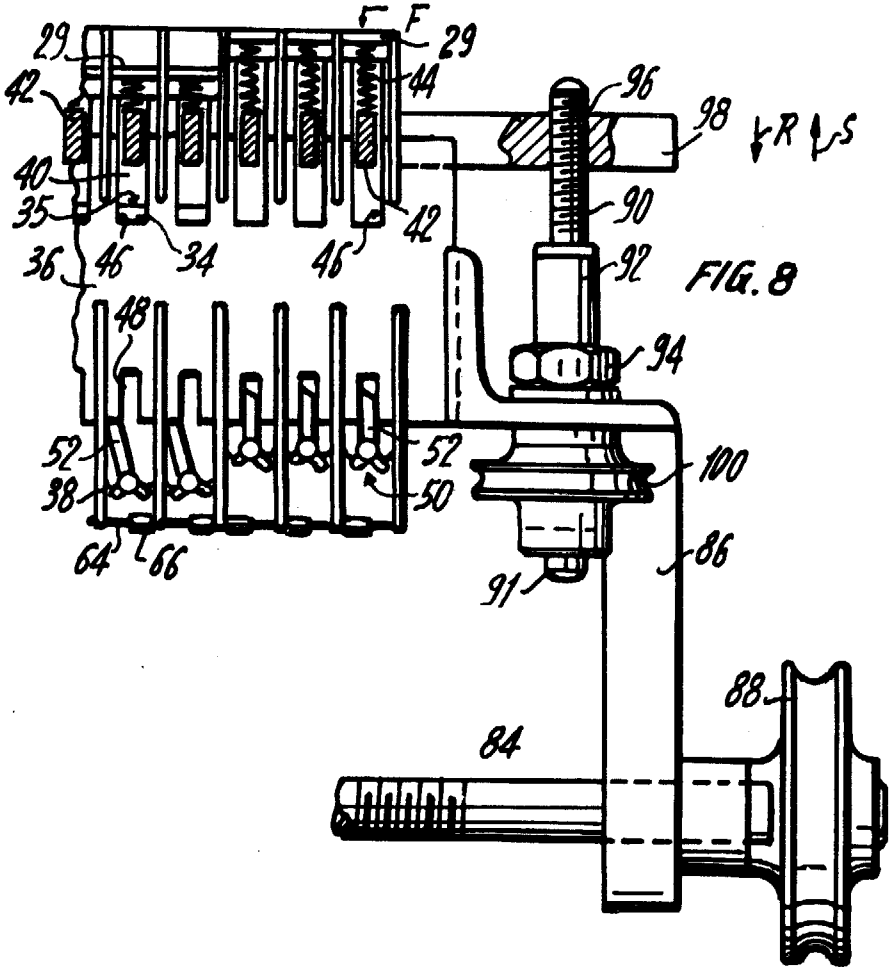
FIG. 8 shows a top view of the right end of a module, five elements and driving means for the display being depicted.
Figure 7:
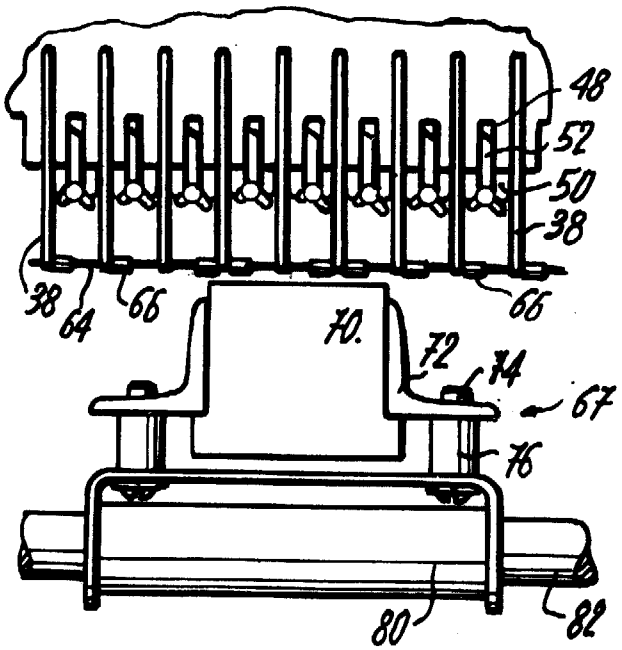
FIG. 7 is a top view of the rear side of a horizontal array of elements.

In FIGS. 7 and 8, details of the means for the setting of the cores 66 and for the setting and resetting of the sliders 34 with their associated projection blocks are shown. A device 67 (FIG. 7) for pre-forming an image and for resetting the pre-formed image is located in a plane behind the panel having a front plane F (FIG. 8). This device comprises tiny electro-magnets 70 arranged in a vertical column; for each horizontal row of elements, one magnet is provided so that, in the described embodiment, 150 magnets 70 are arranged vertically in a column. Each magnet 70 is adapted to influence, when energized, the steel setting cores 66 of its horizontal row. Each magnet 70 is fixed between L-shaped bars 72 which vertically extend over the entire height of the whole module. These L-shaped bars 72 are fixed at their top and bottom ends by distance bolts 76 and screws 74 to U-shaped brackets 78 provided with a sleeve 80. This sleeve is slidably mounted on a guide rod 82 which extends between the vertical frame members of the module. Further U-shaped brackets, sleeves and guide rods (not shown) can be provided at intervals between the uppermost guide rod 82, shown in FIG. 7, and the lowermost one, in order to smoothen the guiding of the magnet displacement device. At an intermediate vertical position between the two terminal guide rods 82, see FIG. 8, an externally threaded driving spindle 84 is provided between the right-hand module frame member 86 and the left-hand one (not shown). The driving spindle 84 is journalled in frame member 86 and bears a drive pulley 88 adapted to receive a drive belt (not shown). The sleeve 80 associated to this driving spindle (not shown) is internally threaded so that, when pulley 88 is rotated, the sleeve 80 on drive spindle 84 is displaced lengthwise over this shaft, and since the sleeve 80 is attached to the vertical L-shaped bars 72, the column of magnets 70 is displaced horizontally behind the panel over the entire width of the module. Electrical connections (not shown) are provided for each magnet 70.

Perpendicularly to the drive spindle 84, an externally threaded resetting drive shaft 90 is journalled in a bearing bush 92 fixed by a nut 94 to the frame member 86. Bearing bush 92 is located above the uppermost row of the display elements of the module. The threaded shaft 90 is screwed into an internally threaded hole 96 of a horizontal resetting grid bar 98; the resetting bars 42 are all fixed, in the same plane, to the horizontal bar 98. The rear end 91 of drive shaft 90 is fixed to a drive pulley 100. A further device comprising a horizontal bar, drive shaft, bearing bush and pulley (not shown) is arranged at the undermost end of the module frame, and the two horizontal resetting grid bars are provided at the left-hand frame member (not shown) with a driving device identical to that shown in FIG. 8, so that the resetting grid, formed by vertical bars 42 and horizontal bars 98, is journalled and driven at the four corners of the module by four driving devices 90, 92, 94 and 100. A driving belt (not shown) goes over all four pulleys 100 in order to rotate them simultaneously. By the rotation of pulleys 100, bars 98 are displaced in the drawing plane of FIG. 8, and bars 42 are thus moved within the slots 40 of the sliders 34 and the recesses 46 of the horizontal guide members 36.

In FIGS. 7 and 8, the driving means for pulleys 88 and 100, stop switches as well as the necessary connections to magnets 70 are not shown. These parts are well known to the man skilled in the art, and their detailed description would unnecessarily complicate this specification.

The different steps of the image pre-forming and the display operation will now be described, and it is recalled that each projecting block 29, 31, 33 (see FIGS. 4, 5, 6, 8) in the interior of its cell (28, 30, 32), i.e. in its retracted position, will give the information "black", and each block appearing in the plane F (FIG. 8) of the display panel, i.e. in its fully advanced position, will provide the information "white".

1.—Pre-image resetting step

Initially, pulley 88 (FIG. 8) is rotated such that the pre-imaging device 67 is moved from an initial position at the right border (against frame member 86) of the module frame, into abutment with the left border of the module frame. During this movement, all magnets 70 are energized so that all setting cores 66 which were in the right hand position, influenced by the magnetic force, are moved to the left abutting to the vertical guide member 38 of each element. At the end of the movement of device 67, all magnets are deenergized. The pre-imaging device 67 thereby places the first (left-hand) column of setting cores 66 in their left position.

2.—Pre-image setting step

The pre-imaging device 67 is now moved from the left to right, pulley 88 being rotated in the inverse direction. During the movement, selected magnets 70 receive a current pulse when they travel behind a particular display element setting core 66, for a period of time identical with the time necessary for the magnet to travel behing the element, when the particular element should display a black spot. The current pulses are provided by an information generator to be described later. Should the dot to be displayed be white, the magnet does not receive a current pulse. An energized magnet shifts the setting core 66 of the display element behind which it travels to the right. If the magnet is not energized, the setting core remains at the left of its element. In FIG. 6, the setting core 66 of element A is at the left since the magnet 70, when travelling behind the element A, was not energized. However, the same magnet had been energized when going behind elements B and C so that the setting cores 66 of these two elements have been shifted to the right. Of course, the same setting operation is simultaneously performed by all 150 magnets vertically arranged in device 67. The image to be displayed is now pre-formed in that all black and white information is stored by the position of all setting cores 66.

3.—Display resetting and information transfer step

When the pre-imaging step (2) is completed, device 67 is in abutment with the right-hand frame member 86, and the rotation of pulley 88 is stopped. Now, pulleys 100 (FIG. 8) are rotated to move reset grid bars 98 and 42 rearwardly (see arrow R in FIG. 8). During this movement, reset bars 42 come in contact with the front end 35 (FIGS. 6 and 8) of sliders 34 so that these sliders are pushed backwards, in the direction of arrow R, until the reset bars 42 come in touch with the end of recesses 46. At this point, the rotation of pulley 100 is stopped by a switch (not shown) in a known manner. The sliders 34 have such a length that, in the rearward end position of bars 42 and sliders 34, the fork of the stop pawl 50 comes in contact with the pre-imaging setting cores 66 and core wires 64. See FIG. 6 wherein the rearward end position is shown for element C. Arm 60 of the fork 58 hits core 66 so that the leg 52 of fork 50, during the rearward movement of slider 34, is shifted to the left where it comes in contact with the left vertical guide means 38 of this element; at the same time, leg 62 is in mechanical contact with wire 64. The corresponding position for element A which has been programmed for white, with core 66 at the left, is shown in dashed lines: arm 60 of fork 58 is in contact with wire 64, and arm 62 in contact with core 66 so that leg 52 remains in parallel position to the longitudinal axis of the display element. If stop pawl 50 was initially in its inclined position, as shown for element B, it will be shifted, as can readily be seen, to its parallel position by the interaction between core 66 and arms 60, 62 of fork 58.

In this manner, a binary information (parallel or inclined) is transferred simultaneously from cores 66 to stop pawls 50. In this operation step, the image to be displayed is stored in the form of the position of all stop pawls 50.

4.—Display setting step

The rotation of driving shaft 90 (FIG. 8) is reversed, and the resetting grid formed by horizontal bars 98 and vertical bars 42 travels in the direction of arrow S. The springs 44 transfer the advancing movement of bars 42 to the sliders 34. All sliders 34 having their stop pawls 50 in parallel position (FIG. 6, element A; FIG. 8, the three left-hand elements) will advance until the front portion of their projection block 29 coincides with the front surface F of the display panel since their stop pawl 50 penetrates with its parallel aligned leg 52 into the guide slot 48 of the horizontal guide 36. All these elements will show "white" on the display panel. All sliders having their stop pawl 50 in inclined position (element B in FIG. 6) do not completely advance but remain in a retracted position since the abutting surface 54 of the stop pawl leg 52 is retained by the stop surface 56 of horizontal guide 36. The further advance of resetting bar 42 will not further advance slider 34 but merely compress the spring 44. All these elements will show "black" on the display panel.

When the stop pawls have become clear from the image setting means 64, 66, the pre-image setting device 67 begins to execute a new resetting step (1 above).

In this way, varying images can be displayed in a rather rapid sequence. For each module, the complete display operation, comprising the four steps described above, may only take 2 to 3 seconds.

It will become clear from the foregoing description that the image display operation has been explained for one module. This operation is substantially the same for all modules of the complete display panel. Each module displays a portion of the complete output image, and each module is programmed in a corresponding manner, and all modules perform simultaneously the same operation step. The feature that the image has been subdivided in modules brings about the great advantage to considerably speeding up the display operation which would last a time equal to the number of modules multiplied by the operation period for each module if the display panel was not subdivided. If an image of a display panel subdivided into 60 modules can be changed all 3 seconds, a non-divided panel would take 180 seconds, i.e. 3 minutes, for each image change. Furthermore, in case of breakdown, a module can rapidly be replaced by another one.

Now, the method and apparatus for programming the pre-imaging device 67 will be described in a summary manner. Electronic parts and devices used therein are familiar to the one skilled in the art. These devices are conventional, commercially available ones and will therefore not be described in detail.

Figure 9:
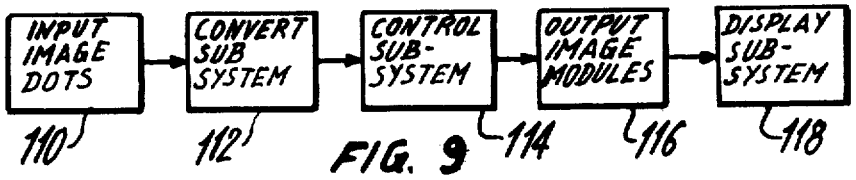
FIG. 9 represents schematically the flowsheet of the imaging and display control systems.

The general design of the display process is schematically shown in FIG. 9. All the individual parts will be described below.

Device 110 is a photoelectric device which scans an imput image and resolves it into dots. Each dot is associated with a binary information as to its brightness, e.g. with one of the data "white" and "black". Device 110 stores all dot data in a memory. However, images can also be produced artificially, e.g. by a computer, a typewriter or similar systems. In this case, the input device 110 converts this crypto-image or code image information into the necessary image dot information.

The device 110 transmits its information to the convert sub-system 112. In this system, the memorized image dot information from device 110 is converted into a form which can control the modules of the display panel. The convert sub-system 112 also divides the total image data into individual programs of the respective modules.

These individual programs are plugged into the respective control sub-systems 114 which are built in each module. The systems comprise appropriate amplifier means the outputs of which energize directly all magnets 70 in each module. System 114 also comprises amplifier and actuating means for driving pulleys 88 and 100 (FIG. 8) as well as synchronizing means in order to synchronize the movement of the pre-imaging devices 67 with the energizing of magnets 70, and timing means for accomplishing the appropriate sequence of operation steps (1) to (4) described above and for their repetition. The signals produced in device 114 are transmitted to the individual magnets 70 representing sub-system 116; Their function and operation has already been described, and to the display sub-system 118 mechanically associated therewith (sliders 34, projection blocks 29, 31, 33, and stop pawls 507).

Figure 10:
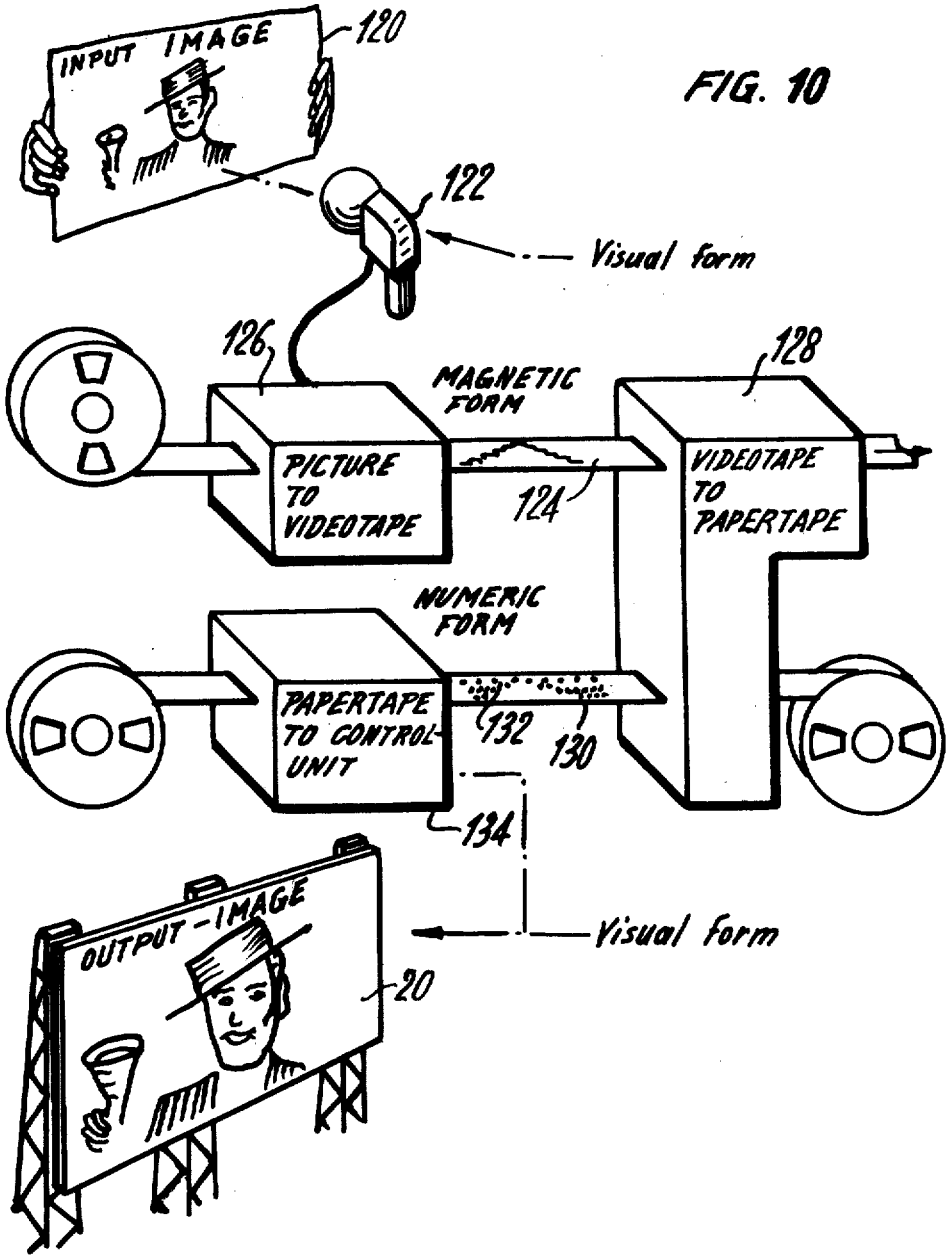
FIG. 10 is a schematical view of the method of transforming an image pattern into the corresponding identical display.

An embodiment of the display process of the invention is represented in FIG. 10.

An input image, having for instance a dimension of 20×30 cm, is scanned by an optical scanner 122 which "reads" the image line by line and resolves each line into dots, substantically like a television camera. The total number of dots is equal to the number of display elements 24 in the display panel 20 (FIG. 1). The scanner 122 equipped with a densitometer produces dot sequence data and, for each dot, data related to its grey value. All these data are recorded on a video tape 124 in magnetic form by the optical-to-magnetical converter 126 well known in the art. Then, the so obtained recorded magnetic tape or videotape 124 can be stored, or it is fed into the magnetic-to-numerical converter 128. This converter transforms the magnetic information in numerical data; in FIG. 10, this converter 128 produces for example a paper tape 130 with punched holes 132. This paper tape 130 is then fed into the control converter 134 which transmits the numerical data to a display panel control unit (not shown) which transforms the numerical data into output pulses for driving and energizing the mechanical, electrical and magnetical means of the display panel modules already described. Finally, the output image appears on the display panel 20 of the invention.

The optical converter 126 controls the scanning operation of the scanner 122. Converter 126 contains a ROM circuit in which the module data are stored. When scanning the input image 120, information must be transmitted to the scanner 122 as well as on the magnetic tape 124 when the horizontal and vertical borders of a display module are reached. Now, the scanner 122 can be arranged to scan the input image portionwise, corresponding to the modules on the display panel 20, or it may scan the input image line by line. In the first case, all dot information associated to a particular module will be recorded on a predeterminated short length of the tape 124. In the second case, each scanned line and line portion appertaining to a particular module will be "labelled" by additional module identification data, and these identification data will permit the converters 128 and 134 to correctly command all modules simultaneously.

The information data related to the grey value of each image dot is treated in a similar manner. The three sub-elements 28, 30 and 32 of each element 24 (see FIGS. 3 and 4) will be actuated for showing "black" or "white" exactly according to Table 1 above. For instance, if a particular dot, say dot no. 1165 in module no. 5, is read by the scanner 122 to have a grey value of 3, this value is recorded on tape 124 together with the dot information 1165 and the module identification 5. The converter 128 prints then on the paper tape 130, in the band appertaining to module no. 5, holes for energizing magnet 70 for the upper sub-element 28 and the lower sub-element 32 of display element no. 1165. When the respective two magnets will then have been energized on module no. 5 during the image preforming step described above, the projection blocks of sub-elements 28 and 32 will remain in their retracted position but that of sub-element 30 will advance. Three ninth of the surface of the display element will therefore be white and five ninth black so that the particular element exactly represents a dot having a grey value of 3.

It will become evident to the man skilled in the art that the described method for transforming an input image to a control means for actuating the display panel can also be performed by other devices which are likewise contemplated by the invention.

The new display panel and method have numerous advantages. The displayed image can be seen in daylight as well as in artificially illuminated rooms and does not need proper illuminating means. The displayed image can be changed very rapidly due to the subdivision of the panel into modules. This advantageous fact permits the display of varying information; for example, sport game results may be displayed followed by an advertisement which is then rapidly replaced by new game results. Image forming information data can readily be stored as a magnetic and/or paper tape so that an image can be repeatedly displayed without necessity of new scanning an input image. Artificial images can be displayed with the same readiness.

Having thus shown and described specific forms which the present invention can assume and the manner in which it may be performed and the utility thereof, it is desired to be understood that such forms were chosen more for the purpose of illustrating the principle and mode of operation rather than for indicating the full scope thereof. It should be emphasized that any modifications, adaptions and alterations may be applied to the specific forms shown, within the scope of the present invention set forth in the appended claims.

What is claimed is:

1. A display system for automatically displaying dot matrix images, comprising:

(1) a generally flat display panel having a generally vertical front plane, a panel body and a rear side, said panel being subdivided into a plurality of display modules having a honeycomb-like structure formed by a plurality of rectangularly shaped display elements;

(2) a projection block having a clear front face slidably disposed in each one of said display elements between a retracted position where its front face is invisible, and an advanced position where its front face visibly coincides with said panel front plane;

(3) slider means fixed to said projection block and extending through said panel body to the rear side thereof;

(4) control means at each one of said slider means;

(5) image preforming means at the rear side of said panel, for producing a preformed image; and (6) image resetting and setting means for resetting a displayed image and for setting and displaying said preformed image transferred to said control means during the image resetting step.

2. A display system for automatically displaying dot matrix images, comprising:

(1) a generally flat display panel having a generally vertical front plane, a panel body and a rear side, said panel being subdivided into a plurality of display modules having a honeycomb-like structure formed by a plurality of rectangularly shaped display elements, each of said display elements being formed by a cell limited by vertical and horizontal walls, a projection block having a clear front face being disposed in each one of said cells, said projection block being movable from a retracted position in the interior of said cell where it is invisible, to an advanced position where its clear front face substantially coincides with said panel front plane and is visible;

(2) flat slider means in each one of said cells having a front and a rear end portion, said front end portion being fixed to said projection block, said flat slider means extending from said projection block to said panel rear side in a horizontal plane and being slidably lodged in said panel body;

(3) control means at said slider rear end portion for permitting or stopping the slider movement towards said panel front plane;

(4) permitting and stopping means at said panel body for cooperation with said slider control means, (5) means for simultaneously actuating all said slider means towards said panel front plane and back from said front plane; and (6) means for pre-forming an image to be displayed at said panel rear side, comprising programming means and programmable binary image dot means for each one of said elements, said dot means being adapted to transmit its information to said slider control means when said slider means is substantially at the end of said movement back from said panel front plane.

3. The display system of claim 1 or 2, wherein said display modules are generally square shaped and each comprises a module body formed by horizontal and vertical guide means for said slider means, said guide means being held together by frame members forming a module frame, said display elements being arranged in vertically aligned columns and horizontally aligned rows.

4. The display system of claim 1 or 2, wherein each one of said rectangular shaped display element is subdivided into three rectangularly shaped sub-elements having each the same width as said display element, their heights and thus their surface areas in said panel front plane being in a ratio of 2/9:3/9:4/9, respectively.

5. The display system of claim 2, wherein said control means comprises a stop pawl attached for horizontal pivoting movement to a said rear end of each slider means, and said permitting and stopping means comprises a rectangular slot and an abutment in said panel body, said stop pawl having a leg directed to the interior of said panel body and a two-arm fork directed to said panel rear side, said stop pawl having two control positions, said leg being arranged to fit into said rectangular slot in the first one of said control position and to come into touch with said abutment in the second control position.

6. The display system of claim 2 wherein said panel body and slider means comprise vertically aligned openings and said slider actuating means comprises an image control grid formed by a plurality of vertically disposed control bars, each one of said controls bars traversing all said vertically aligned panel body and slider means openings of one vertically aligned display element column, and by a first horizontal grid bar solidly fixed to the top end of all control bars above the uppermost horizontal row of display elements, and a second horizontal grid bar solidly fixed to the bottom end of all control bars below the undermost horizontal row of display elements, spring means being inserted between said control bars and each one of said projection blocks, said slider actuating means further comprise driving means for applying a to-and-fro movement of said control grid in a direction towards the panel plane and towards the panel rear side, said movement being limited by the lengthwise dimension of said openings.

7. The display system of claim 3 wherein said panel body and slider means comprise vertically aligned openings and said slider actuating means comprises an image control grid formed by a plurality of vertically disposed control bars, each one of said control bars traversing all said vertically aligned panel body and slider means openings of one vertically aligned display element column, and by a first horizontal grid bar solidly fixed to the top end of all control bars above the upper most horizontal row of display elements, and a second horizontal grid bar solidly fixed to the bottom end of all control bars below the undermost horizontal row of display elements, spring means being inserted between said control bars and each one of said projection blocks, said slider actuating means further comprise driving means for applying a to-and-fro movement of said control grid in a direction towards the panel front plane and towards the panel rear side, said movement being limited by the lengthwise dimension of said openings.

8. The display system of claim 1, wherein said programmable binary image dot means comprises a plurality of horizontal wires disposed in a vertical plane at said panel rear side, each one of said wires being arranged behind one display element row, and a plurality of cylindrical steel cores slidably disposed on said wires, one of said cores behind each one of said display elements, and said programming means comprises a column of a plurality of vertically aligned electromagnets, each one of said electromagnets being aligned to one of said wires, said column being movably journalled behind said vertical wire plane for lateral movement behind said wires and cores, for individually displacing said cores on said wires by magnetic forces.

9. The display system of claim 5, wherein said programmable binary image dot means comprises a plurality of horizontal wires disposed in a vertical plane at said panel rear side, each one of said wires being arranged behind one display element row, and a plurality of cylindrical steel cores slidably disposed on said wires, one of said cores behind each one of said display elements, and said programming means comprises a column of a plurality of vertically aligned electromagnets, each one of said electromagnets being aligned to one of said wires, said column being movably journalled behind said vertical wire plane for lateral movement behind said wires and cores, for individually displacing said cores on said wires by magnetic forces.

10. The display system of claim 5, wherein each one of said cylindrical steel cores is displaceable behind its appertaining display element between a first lateral end position and a second lateral end position, and the arms of said two-arm fork forming different angles with its leg, said stop pawl being arranged to take the first control position when said fork is in contact with said core in its first lateral end position, and to take the second control position when said fork in in contact with said core in its second lateral end position.

11. The display system of claim 7, wherein each one of said cylindrical steel cores is displaceable behind its appertaining display element between a first lateral end position and a second lateral end position, and the arms of said two-arm fork forming different angles with its leg, said stop pawl being arranged to take the first control position when said fork is in contact with said core in its first lateral end position, and to take the second control position when said fork is in contract with said core in its second lateral end position.

12. A process for automatically displaying a series of dot matrix images comprising the following steps:

(1) providing a magnetic record of an input image, said magnetic record comprising dot-by-dot information of the input image, (2) converting said magnetic record into electrical pulses for digitally energizing an image preforming system, (3) setting a preformed dot matrix image behind a display panel, (4) resetting to darkness an output image already displayed on said display panel and transferring said preformed image to individual display means during the resetting step, (5) setting an output image corresponding to the transferred preformed image, and (6) resetting the preformed dot matrix image behind the display panel.

13. The process of claim 12, wherein in step (1) the magnetic record is further provided with graded brightness information data for each dot, said brightness data being also included into said preformed image in step (3).

14. The process of claim 12 in step (2) the magnetic record is converted into a numerical record of a punched tape, said numerical record providing amplified electrical pulses for energizing a plurality of electromagnets.

15. The process of claim 12 or 14, wherein a column of vertically aligned electromagnets is moved behind the display panel, the position of steel cores is influenced by magnetic forces created in said magnets by said electrical pulses, said preformed image being produced by the neutral position of said steel cores.

16. The process of claims 12 or 14, wherein the already displayed output image is reset by simultaneously retracting of a plurality of projection blocks, the preformed image is transferred to control means associated with each projection block, each of said control means coming in touch with each of said steel cores during the retracting movement of all projection blocks, each of said steel cores pivoting said control means in a "black" or a "white" position, according to the particular position of each steel core, and the output image is set by simultaneously advancing of all projection blocks toward the front plane of said display panel, those projection blocks the control means of which are in the "black" position being retained in the body of said display panel.

17. The process of claim 16, wherein the already displayed output image is reset by simultaneously retracting of a plurality of projection blocks, the preformed image is transferred to control means associated with each projection block, each of said control means coming in touch with each of said steel cores during the retracting movement of all projection blocks, each of said steel cores pivoting said control means in a "black" or a "white" position, according to the particular position of each steel core, and the output image is set by simultaneously advancing of all projection blocks toward the front plane of said display panel, those projection blocks the control means of which are in the "black" position being retained in the body of said display panel.

18. The process of claim 12 wherein the magnetic record is provided in step (1) by scanning an input image in a dot-by-dot manner in linewise sequence, said input image being scanned portionwise, each portion comprising a square-shaped surface area fraction of the input image, said display panel being divided in a number of modules corresponding to the number of said surface area fractions of the input image.

* * * * *